United States Patent [19]

Crichlow

[11] 4,280,790

[45] Jul. 28, 1981

[54] CENTRIFUGAL PITOT PUMP WITH MEANS FOR IMPROVING NET POSITIVE SUCTION HEAD

[75] Inventor: Walter W. Crichlow, La Habra Heights, Calif.

[73] Assignee: Kobe, Inc., Huntington Park, Calif.

[21] Appl. No.: 15,120

[22] Filed: Feb. 26, 1979

[51] Int. Cl.[3] ..... F04D 1/14

[52] U.S. Cl. ..... 415/89

[58] Field of Search ..... 415/89, 88, 170 R, 172 R

[56] References Cited

U.S. PATENT DOCUMENTS

| | | | |
|---|---|---|---|
| 3,795,459 | 3/1974 | Erickson et al. | 415/89 |
| 3,838,939 | 10/1974 | Erickson et al. | 415/89 |
| 3,977,810 | 8/1976 | Erickson et al. | 415/89 |
| 3,994,618 | 11/1976 | Erickson | 415/89 |
| 4,183,713 | 1/1980 | Erickson et al. | 415/89 |

*Primary Examiner*—Stanley N. Gilreath

*Attorney, Agent, or Firm*—Christie, Parker & Hale

[57] ABSTRACT

A centrifugal pitot pump has a rotor driven in rotation within a casing. A pitot tube pickup in a rotor chamber within the rotor intercepts rotating fluid and withdraws the fluid through a duct. The duct mounts the pitot tube and passes through the rotor casing. Fluid to be pumped passes through the annulus between the rotor and the duct and up through generally radial passages in the rotor into the rotor chamber. A leakage path from the rotor chamber to the inlet annulus between a hub of the pitot tube pickup and the rotor permits fluid to pass from the chamber into the annulus. A ring interrupts line-of-sight communication between the chamber and the annulus along the leak path and dissipates considerable of the leaking fluid velocity head to thereby improve the net positive suction head of the pump. The entrances of the radial passages in the rotor are large in the axial direction to reduce the sharpness of the turn from the annulus into these passages, to thereby reduce the net positive suction head required to operate the pump without cavitation.

7 Claims, 4 Drawing Figures

CENTRIFUGAL PITOT PUMP WITH MEANS FOR IMPROVING NET POSITIVE SUCTION HEAD

BACKGROUND OF THE INVENTION

The present invention relates in general to centrifugal pumps of the pitot tube type, and, more in particular, to an improvement in such pumps that reduces the net positive suction head required to prevent cavitation.

Centrifugal pumps of the pitot type are well known. In general, these pumps include a drive that drives a rotor in rotation within a casing. A pitot pickup in a chamber of the rotor and stationary relative to the rotor intercepts fluid within the chamber and draws that fluid from the chamber. The exiting fluid has a head larger than its inlet fluid head because of energy imparted to the fluid by the rotor. Typically, fluid enters the rotor chamber along a path that includes an annulus surrounding the pitot tube mount and inside the rotor. From this annulus the fluid passes through a plurality of generally radial passages in the rotor to exit near the outer radial limit of the rotor chamber. The pitot inlet in the chamber may be comparatively close to the outer radial limits of the chamber or comparatively close to the axis of rotation of the rotor, depending on the application.

Typically, the pitot tube mount is in the form of a duct or tube extending along the axis of rotation of the rotor and through a wall of the rotor, usually a rotor cover. The duct is attached to the casing, or some other stationary support.

Pitot pumps are noted for their ability to impact large increase in head in the fluid being pumped. Adaptations of these pumps into separators and cleaners are possible because of the opportunity to stratify fluids within the rotor chamber and sort materials according to their density. Stratification, of course, comes from the large centrifugal force field present within the rotor chamber. An example of this application is a separator for separating solids from a liquid. In petroleum applications it is not uncommon to use production fluid from a petroleum well to power downhole machinery. This fluid must be free of solids. A pitot separator separates solids from the power fluid by centrifugal action and removes the solids either through a pitot pickup or nozzles in the wall of the rotor. A second, clean pitot tube pickup draws solid-free material from the chamber. Thus, in this application, it is possible to have more than one pitot pickup within the chamber. Separators, too, can use multiple head pitot pickups, as well as weir-like take-offs from the chamber in the walls of the rotor.

Known pitot pumps include those described in the following U.S. Pat. Nos.: 3,384,024; 3,776,658; 3,795,459; 3,817,659; 3,838,939; 3,926,534; 3,960,319; 3,977,810; and 3,994,618.

In these pitot-type pumps and separators, the duct mounting the pitot tube extends through a wall of the rotor. The duct is stationary while the wall rotates. Fluid inside of the rotor has a considerably higher head than incoming fluid in the annulus on the outside of the duct. Fluid leaking from the rotor chamber into the annulus has a deleterious effect on the net positive suction head of the pump. The net positive suction head (NPSH) is that pressure over and above the vapor pressure of the fluid being pumped within the inlet of the pump required to prevent cavitation in the pump inlet. Cavitation is localized vaporization of fluid. Cavitation adversely affects pump performance by reducing flow rate and discharge head. Cavitation also physically degrades the pump, often quite quickly. In previous designs, the interface between the rotor and the duct provided a labyrinth path for fluid through a plurality of axially spaced, circular grooves on the outside of the duct. Nonetheless, line-of-sight communication between the rotor chamber and the duct above the lands of the grooves and within the bore of the rotor receiving the duct permitted fluid from within the rotor to enter the duct resulting in a high velocity head, even jet-like, with the harmful impact on net positive suction head.

SUMMARY OF THE INVENTION

The present invention provides in a pitot type pump means for improving the net positive suction head by blocking a direct leak path of fluid from a rotor chamber of the pump into a fluid inlet passage to the chamber but outside that chamber and along an interface between the pitot tube and the rotor.

One form of the present invention provides a pitot pump with a rotor having a chamber in which a pitot tube pickup is disposed. A duct passing through an end wall of the chamber and the rotor supports the pitot tube. An interface between the duct and wall provides a leak path between the rotor and an inlet passage into the rotor chamber. A barrier in this leak path prevents line-of-sight communication between the inlet and the rotor chamber.

It has been found that despite the presence of a leak path between the rotor chamber and the inlet, interrupting line-of-sight communication between the two results in an improvement in the net positive suction head for the pitot pump. It is thought that the problem has been with the line-of-sight communication, permitting the fluid from the rotor chamber to jet into the entrance with adverse consequences on net positive suction head. By interrupting line-of-sight communication, the jet dissipates and the suction head improves.

To further enhance net positive suction head, radial passages of the rotor communicating with the entrance passage have large openings in the direction of fluid flow in the entrance, almost invariably axial.

In a detailed form, the present invention contemplates a centrifugal pump of the pitot tube type that employs a rotor havng a rotor chamber within it. The rotor is adapted to be driven in rotation by some prime mover, such as an electric motor. A casing houses the rotor and provides a shroud. The pitot tube pickup within the chamber mounts on a duct that extends coaxially with the rotor through an end wall of the rotor and anchors to a stationary part of the pump. The pitot tube and duct form a pitot tube assembly. The duct has an axial passage in communication with the entrance of the pitot tube for the discharge of fluid from the pump. An annulus around the duct provides the entrance into the rotor chamber, and it is this annulus that receives discharge through the leak path between the rotor chamber and the inlet. A circular lip received in a groove prevents line-of-sight communication through the leak path from the rotor chamber to the inlet. Generally, radial passages extend from the annulus to outlets proximate the outer radial limit of the chamber. These radial passages at their entrances are wider in cross section than in their medial portions in order to further improve net positive suction head.

These and other features, aspects and advantages of the present invention will become more apparent from the following description, appended claims and drawings.

DESCRIPTION OF THE PREFERRED EMBODIMENT

Figure 1:
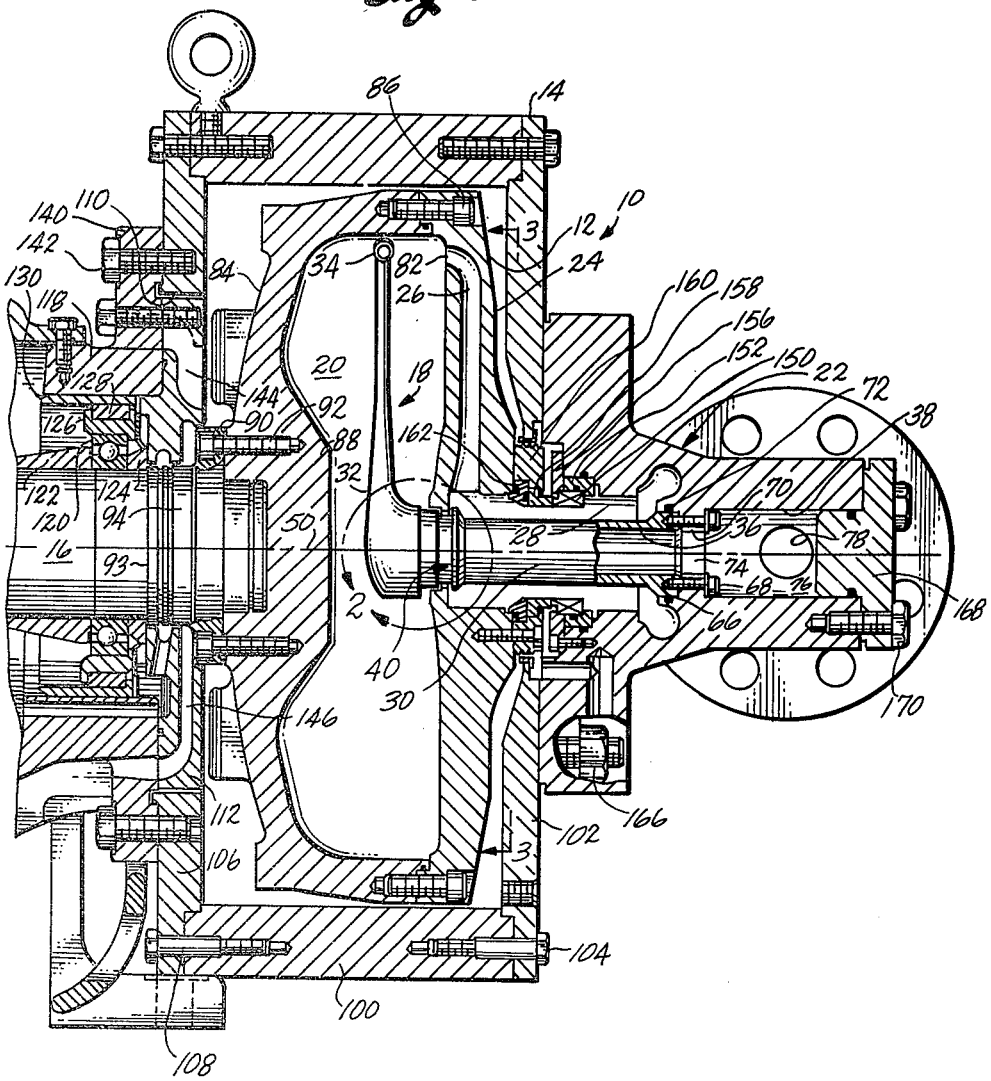
FIG. 1 is a side elevation, predominantly in half section, of the preferred construction of a centrifugal pitot pump with the improved pitot assembly-to-rotor interface of the present invention.

With reference in general to FIG. 1, pitot pump 10 is shown in side elevation. The general organization of the pump includes a rotor assembly 12 disposed within a casing 14 for rotation. A drive shaft 16 drives the rotor in rotation. The drive shaft is adapted to be coupled to a prime mover, such as a motor. A pitot tube assembly 18 is stationary relative to the rotor, the assembly extending from outside the rotor into a rotor chamber 20 within the rotor. Outside the rotor, the pitot tube anchors to a stationary part of the pump by attachment to manifold 22.

Rotor 12 includes a rotor cover 24. A plurality of generally radial passages 26 in the cover open at their outer ends into chamber 20 and open at their inner ends into an annulus 28. Annulus 28 feeds fluid to passages 26. Pitot tube assembly 18 includes a tube or duct 30 that defines the inner wall of annulus 28. A pitot tube arm 32 extends from an interior end of duct 30 (with respect to the rotor) radially within chamber 20. A scoop 34 caps the arm and provides the entrance for fluid to enter the pitot tube assembly. Duct 30 has a passage 36 extending through it to a discharge chamber 38.

Manifold 22 receives inlet fluid from a source and passes that fluid into annulus 28. Fluid passes through annulus 28 and into radial passages 26 for discharge into rotor chamber 20. Rotor 12, rotated by the prime mover, increases the head of the fluid as it passes up passages 26. Fluid within chamber 20 will have a higher head than fluid within annulus 28. This fluid will eventually be taken off by scoop 34, passed through arm 32 and through duct 30, and into discharge chamber 38.

Figure 2:
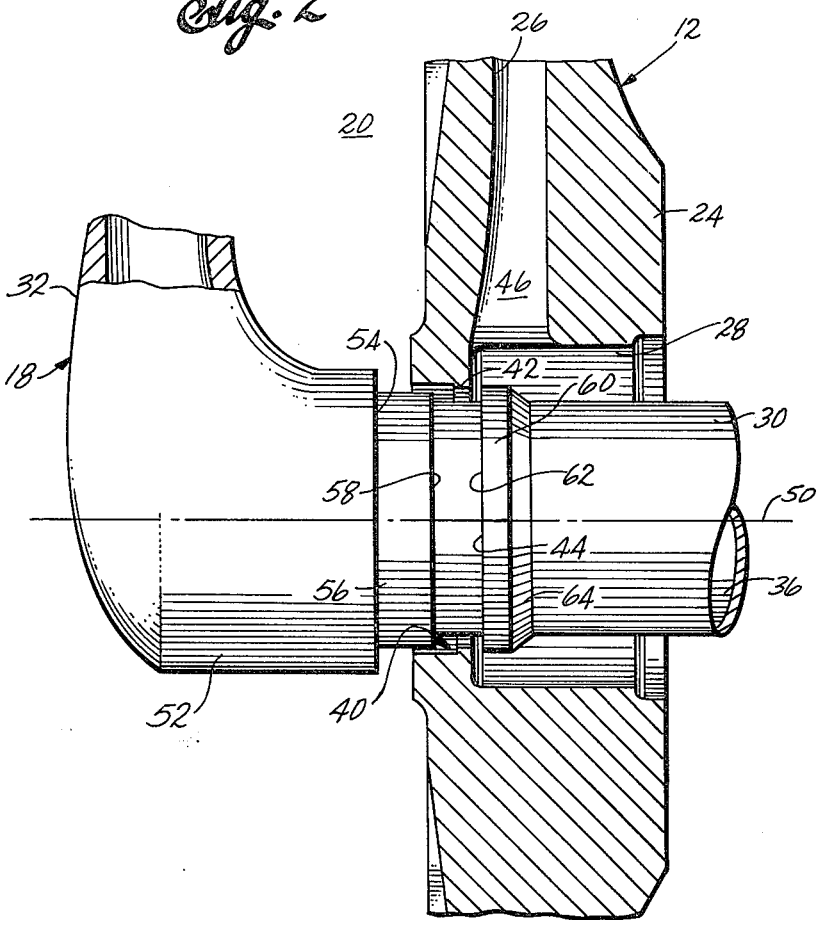
FIG. 2 illustrates the preferred pitot tube assembly and rotor interface illustrated in FIG. 1 in the area bounded generally by lines 2—2.

With reference to FIG. 2, a leak path exists along the interface between rotor 12 and pitot tube assembly 18 communicating rotor chamber 20 and inlet annulus 28. This leak path is indicated in general by reference character 40. Fluid passes from chamber 20 into annulus 28 through path 40. An annular, circular ring 42 in the wall of cover 24 prevents therefore line-of-sight communication between chamber 20 and annulus 28. An annular, circular channel 44 radially inside of ring 42 but on pitot tube assembly 18 receives the ring. The axial width of channel 44 exceeds the axial width of ring 42 to provide tolerance clearance between the radial walls of the channel and the ring. Fluid will then flow from chamber 20 into annulus 28 about ring 42 but will be intercepted by the ring. It has been found that with the provision of the ring, this fluid flow is considerably less energetic and velocity head is dissipated. The ring interrupts the jet-like flow that would otherwise exist. With the interruption, an adverse effect of net positive suction head is attenuated.

A further improvement in the net positive suction head results from increasing the axial reach of the mouth of passages 26. A widened mouth 46 for these passages parallel to an axis 50 of the pump reduces corner losses of fluid passing from entrance 28 into passages 26 by reducing the sharpness of the corner. As will be developed subsequently, this increase in the axial span of the mouth for passages 26 is accompanied by a decrease in the rotary or circumferential span of the mouth. See FIG. 3.

In greater detail and with reference to both FIGS. 1 and 2, pitot tube assembly 18 is an integral assembly of arm 32 and duct 30. This assembly must pass through rotor cover 24. Thus the diameter of the duct cannot exceed the inside diameter of ring 42. Pitot tube assembly 18 in the vicinity of leak path 40 includes a hub or an elbow 52 at the base of arm 32. The elbow ends in a radial shoulder 54 that steps the diameter of the pitot tube assembly down to about the same as the inside diameter of ring 42. An annular, axially extending land 56 extends from shoulder 54 to channel 44. A shoulder 58 of channel 44 extends from the base of the channel to land 56. On the opposite end of channel 44, a flange 60 extends radially from duct 30 to a diameter about the same as the inside diameter of ring 42. A shoulder 62 of channel 44 and a flange 60 extends radially of axis 50. Flange 60 thus forms a land for channel 44. A tapered shoulder 64 extends from the major diameter portion of flange 60 to a reduced diameter section of duct 30 that exists away from leak path 40. Thus, flange 60 also acts as a dam in reducing the effect of the fluid from chamber 20 entering annulus 28.

With reference again to FIG. 1, duct 30 extends along axis 50 away from the zone of leak path 40 towards chamber 38. A flange 66 extends radially away from the adjacent portion of duct 30 to provide an anchor for the duct in manifold 22. This anchor is effected through a plurality of fasteners 68 that secure the duct to an interiorly extending radial flange 70 of the manifold. An O-ring 72 between the manifold and the duct seals the outgoing fluid in the duct from escaping into incoming fluid in annulus 28. A stub passage section 74 in the manifold extends between a chamber 76 of the manifold and passage 36 of the duct. Chamber 76 opens into an exit passage 78.

Figure 3:
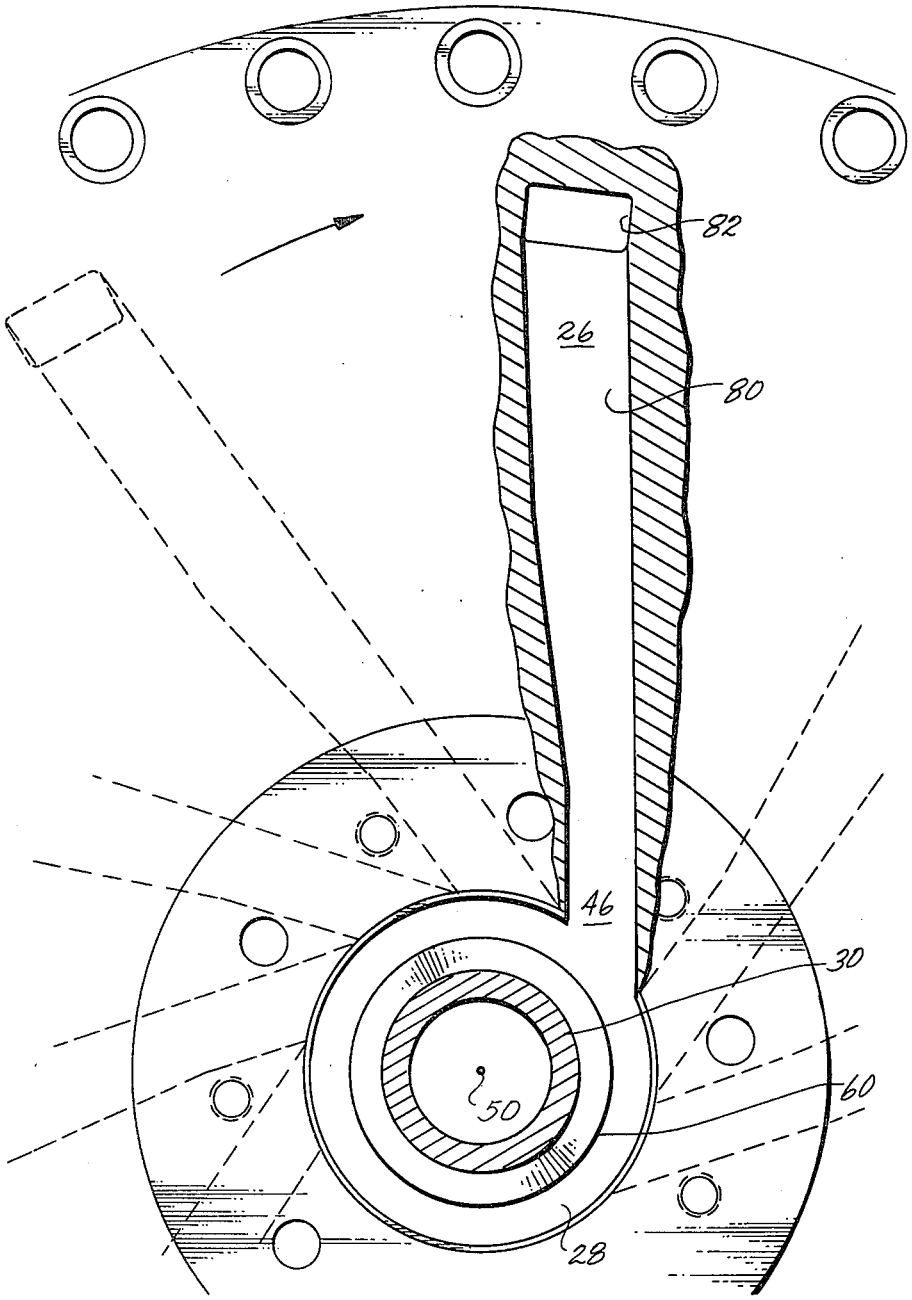
FIG. 3 illustrates in end elevation and partly fragmented the generally radial passages in a cover of the rotor taken generally along lines 3—3 of FIG. 1.

Annulus 28 within cover 24 opens into a plurality of passages 26, as can be seen in FIG. 3. Considered generally radially of axis 50, mouths 46 for passages 26 are narrow at their entrances and widen in the direction of rotor rotation as the radial distance from axis 50 increases to a fully developed passage section 80. With this increase in width of passages 26 in the direction of rotor rotation, passages 26 narrow in the direction along axis 50 in an amount corresponding to the widening in rotational direction so as to present substantially the same cross-sectional area to the flow of fluid through the passage. Passages 26 turn axial at their ends to exit through exit ports 82 into chamber 20. Passages 26 are slightly off radii from axis 50 to compensate for rotation of the passages with respect to annulus 28. The direction of rotation is indicated by the arrow in FIG. 3.

With reference to FIG. 1, pitot tube arm 32 extends from elbow 52 radially within chamber 20. The outside of the arm progressively narrows with increases in radius in a known fashion. Initially, the arm reaches a minimum thickness facing the rotary motion of fluid within chamber 20 so as to reduce drag. Scoop 34 that caps the arm intercepts the fluid and directs it down through the arm and into passage 36 for discharge.

With continued reference to FIG. 1, rotor 12 is formed of a deeply dished drum 84 that forms the radial boundaries of chamber 20 and one end boundary. Cover 24 attaches to drum 84 as through a plurality of fasteners 86 between the two and provides the other end boundary. Drum 84 has a hub 88 that secures the rotor to a mounting flange 90 at the end of drive shaft 16. Attachment is through fasteners 92.

Drive shaft 16 extends from a prime mover to mounting flange 90 and steps up before meeting the flange at a shoulder 93 of an axially extending section 94.

Casing 14 has a cylindrical section 100 that spans the axial extent of rotor 12. An end plate 102 attaches to cylindrical section 100 through fasteners 104. A second end plate 106 attaches to cylindrical section 100 through fasteners 108. End plate 106 has a large diameter hole 110 that receives a bearing retainer plate 112. This plate extends radially of section 94 of drive shaft 16. The retainer plate nests within a hub 118 of a lubricant reservoir and journal assembly for the drive shaft. This reservoir assembly has been largely omitted because it is of standard configuration. A bearing 120 for the interior end of drive shaft 16 is received on the drive shaft. An oil slinger 122 directs oil at the bearing. A second oil slinger 124 on the opposite side of bearing 120 does the same thing. A bearing retainer 126 receives bearing 120. A bearing mount spring ring 128 in turn receives the bearing retainer. A sleeve 130 receives this entire assembly. Sleeve 130 is received within hub 118. Hub 118 has a radially extending flange 140 that secures to plate 106 through fasteners 142. A breather passage 144 in end plate 106 communicates the volume outside of rotor 12 and within casing 14 to atmosphere. A lubricant bleed passage 146 through plate 112 and hub 118 drains lubricant to outside the pump.

At the other end of the pump, a seal 150 is disposed radially within a seal adapter 152 that is in turn received in a bore manifold 22. An O-ring between seal adapter 152 and this bore prevents leakage along the interface between the two. A second O-ring between the seal adapter and the seal prevents leakage along the interface between these two items. A seal clamp ring 156 on the inside of adapter 152 bears on one axial end of the seal and the adapter bears on the other axial end of the seal. These three elements are stationary. A ring 158 within a retainer 160 seals against seal 150. A spacer 162 positions ring 160 relative to seal 150. O-rings between the interfaces of this spacer and the rotor cover and the ring seal these interfaces.

Manifold 22 secures to end plate 102 as through fasteners 166. Chamber 76 of manifold 22 is capped by a plug 168 which is secured to the manifold as by fasteners 170. An O-ring may be provided between the plug and the walls of chamber 76 to effect a seal.

Figure 4:
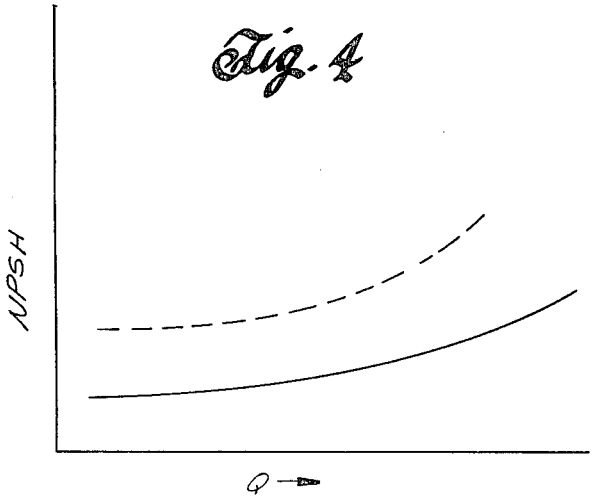
FIG. 4 is a plot of net positive suction head versus flow rate illustrating the improvement in that pump characteristic because of the construction of the pitot assembly rotor interface.

FIG. 4 illustrates the improvement in the net positive suction head attendant with the present invention. The ordinate shows net positive suction head required to operate the pump without cavitation. The abscissa shows the flow rate of the pump. The upper, dashed line shows the net positive suction head of the pump without the lip and channel of the present invention. The lower, solid line shows the net positive suction head requirements with the lip and channel of the present invention. It is clear from the plot that the improvement in net positive suction head obtains for a large range of flow rates.

The operation of the present invention has been described earlier in connection with specific structural functions but an overall description will be presented here.

Rotor 12 is caused to rotate within casing 14 and this causes fluid to enter chamber 20 of the rotor through the following path. The fluid enters manifold 22 and from there flows into annulus 28. There, the fluid flows axially of the pump outside duct 30. Then the fluid enters generally radial passages 26. Within these passages, the fluid picks up head. The fluid discharges out outlets 82 and into chamber 20. There, the head can be further increased. The net positive suction head required to maintain satisfactory fluid flow through the pump varies considerably with the fluid losses into the chamber. With large losses due to fluid head losses in the inlet path, the net positive suction head requirement for the pump increases.

Assuming an adequate net positive suction head to operate the pump, fluid is drawn off from chamber 20 through scoop 34 and flows down through arm 32, out passage 36, into chamber 76, and out exit passage 78. During operation, a substantial pressure differential exists between chamber 20 and annulus 28.

Production tolerance requirements require that a fairly substantial leak path exist between chamber 20 and inlet annulus 28 along path 40. With the substantial driving pressure differential between chamber 20 and annulus 28, fluid flows along a leak path 40 at a high velocity. If this leaking fluid is allowed to enter annulus 28 with its velocity unabated, the net positive suction head requirements for the pump increase substantially. The presence of the lip and channel arrangement of lip 42 and channel 44 substantially attenuates the adverse effect of leakage on the net positive suction head. The lip and channel reduce the jet-like flow of the escaping head, and an effective restriction in the mouth of passages 26 and annulus 28 is removed. It is noted that a head loss exists with or without the lip from the loss of the velocity head of the fluid flowing from the chamber to the annular passage. This loss with the invention, however, takes place away from the mouth and annulus.

The present invention has been described with reference to a preferred embodiment. The spirit and scope of the appended claims should not, however, necessarily be limited to the foregoing description.

What is claimed is:

1. In a rotary pitot pump of the type that includes a rotor casing, a rotor rotatably mounted in the casing and having a chamber, a pitot tube disposed within the chamber having a scoop to receive fluid and a passage from the scoop, a mounting duct extending from a stationary portion of the pump through the rotor and into the chamber, a passage in the duct communicating with the passage in the pitot tube for the discharge of fluid therefrom, an inlet into the rotor casing on the outside of the duct, a leak path between the chamber and the inlet along the interface between the rotor and the duct, and a plurality of radial passages from the inlet into the rotor chamber proper, an improvement which comprises:

an annular ring and a channel in the leak path between the rotor and the duct interrupting line-of-sight communication between the rotor chamber and the inlet, the annular channel receiving the ring and providing a flow path around the ring, the axial extent of the channel being greater than the axial extent of the ring.

2. The improvement claimed in claim 1 wherein the duct has an annular channel receiving the ring and providing a flow path around the ring, the axial extent of the channel being greater than the axial extent of the ring.

3. The improvement claimed in claim 2 wherein one axial end of the annular channel is defined by a flange in the inlet, the flange extending radially from the duct to substantially the diameter of the inside of the ring, the duct extending from the channel away from the ring at a diameter less than the flange.

4. In a pitot pump of the type having a casing and a rotor with a rotor chamber, the rotor being mounted for rotation about an axis of the pump and within the case, means for driving the rotor in rotation within the casing, a pitot tube pickup within the rotor chamber disposed to intercept fluid rotating therein, a duct coaxial with the axis of rotation of the rotor and attached to the pitot tube, the duct and the pitot tube providing communication from within the rotor chamber to outside the rotor chamber, means securing the duct to a stationary portion of the pump, an annular passage on the outside of the duct to supply inlet fluid to the rotor chamber, generally radial passage means from the annular passage into the rotor chamber, and an interface between the rotor and the duct providing a leak path between the rotor chamber and the annulus, an improvement which comprises:

(a) a ring and a channel in the leak path preventing direct line-of-sight communication between the rotor chamber and the annulus, the channel receiving the ring and providing a flow path around the ring, the axial extent of the channel being greater than the axial extent of the ring; and (b) a mouth of the generally radial passages having a greater axial extent than the medial and end portions of the radial passages, the mouth smoothly converging into the medial section, the width of the mouth in planes at right angles to the axis being narrower than the corresponding widths of the medial and end sections of the passages, the cross-sectional area of the radial passages from mouth to end being substantially constant.

5. The improvement claimed in claim 4 wherein the pitot tube pickup has a hub, a shoulder stepping the hub down to an axially extending land, the channel being adjacent the land, an external flange at the other end of the channel, and the ring is disposed in the channel.

6. The improvement claimed in claim 5 wherein the ring is formed in the rotor and the channel is formed in the duct.

7. The improvement claimed in claim 6 wherein the flange has a diameter greater than the diameter of the duct in the annular passage away from the flange and opposite the channel.

* * * * *